US006474025B1

(12) United States Patent
Faiks et al.

(10) Patent No.: US 6,474,025 B1
(45) Date of Patent: Nov. 5, 2002

(54) WORKSTATION

(75) Inventors: Frederick S. Faiks, Greenville; Mitchell Niewiadomski, Lowell, both of MI (US)

(73) Assignee: Steelcase Development Corporation, Caledonia, MI (US)

( * ) Notice: Subject to any disclaimer, the term of this patent is extended or adjusted under 35 U.S.C. 154(b) by 44 days.

(21) Appl. No.: 09/723,729

(22) Filed: Nov. 28, 2000

(51) Int. Cl.[7] ..... E04H 1/00
(52) U.S. Cl. ..... 52/36.1; 52/64; 52/239
(58) Field of Search ..... 52/36.1, 64, 65, 52/220.1, 220.7, 239, 238.1

(56) References Cited

U.S. PATENT DOCUMENTS 5,687,513 A * 11/1997 Baloga et al. ..... 52/32
6,248,014 B1 * 6/2001 Collier ..... 454/228

* cited by examiner

*Primary Examiner*—Carl D. Friedman
*Assistant Examiner*—Naoko Slack
(74) *Attorney, Agent, or Firm*—Foley & Lardner

(57) ABSTRACT

A workstation is disclosed. The workstation includes a primary worksurface configured for rotation and coupled to a base configured for rotation, a seat for a user coupled to the base, and a secondary worksurface at least partially surrounding the primary worksurface. The primary worksurface is available to a user on rotation of the primary worksurface and the secondary worksurface is selectively available to the user on rotation of the primary worksurface. A workstation having a rotatable worksurface coupled to the base, a seat for a user coupled to the base, and a partition configured for attachment to the worksurface is also disclosed. A workstation having a primary worksurface configured for rotation and coupled to a base configured for rotation, a hub having an input utility carrier from a utility from a utility supply source, and an output utility carrier operatively coupled to the input utility carrier and communicating between the hub and the primary worksurface for transmitting utilities from the utility supply source to the primary worksurface is also disclosed.

43 Claims, 12 Drawing Sheets

WORKSTATION

CROSS-REFERENCE TO RELATED APPLICATIONS

The following U.S. patent applications are hereby incorporated by reference: U.S. patent application Ser. No. 09/724,193 titled "FRAME SYSTEM" filed on Nov. 28, 2000.

FIELD OF THE INVENTION

The present invention relates to a workstation.

BACKGROUND

It is well known to provide for a workstation for use by one or more workers in a work environment. Workstations formed by an arrangement of partial height partition walls are well known. In such workstations, it is common to provide a fixed worksurface on which one or more accessories or appliances may be placed as well as a chair or the like for a worker using the workstation. Such workstations typically have at least one opening into which the worker and/or visitors to the workstation may enter. However, in such workstations the "privacy" of the worker is often compromised by the ease with which visitors may enter—or gain physical and/or visual access to—the workstation. Moreover, the "fixed" nature of the worksurface (and accessories and/or appliances) in the workstation may also make it difficult for the worker conveniently to adjust to a position that enhances privacy or the ability to concentrate or a work assignment or the ability to protect confidential or secure information from visibility (for example, because interconnection to accessories or appliances may be obstructed or obstructive).

Accordingly, it would be advantageous to provide for a workstation that allows a worker conveniently to adjust from an open position allowing visual and/or physical access by visitors to a closed position restricting visual and/or physical access by visitors. It would also be advantageous to provide for a workstation that allows a worker to maintain interconnection to accessories or appliances when adjusting the position within the workstation. It would further be advantageous to provide for a workstation having a selectively movable worksurface between an open position and a closed position (as well as intermediate positions allowing relative adjustment of access by visitors). It would further be advantageous to provide for a workstation having a privacy screen that can be installed to enhance the privacy of the worker and restrict access by visitors.

Accordingly, it would be desirable to provide a workstation having one or more of these or other advantageous features.

SUMMARY

The present invention relates to a workstation having a primary worksurface configured for rotation and coupled to a base configured for rotation, a seat for a user coupled to the base, and a secondary worksurface at least partially surrounding the primary worksurface. The primary worksurface is available to a user on rotation of the primary worksurface and the secondary worksurface is selectively available to the user on rotation of the primary worksurface.

The present invention also relates to a workstation having a rotatable worksurface coupled to the base, a seat for a user coupled to the base, and a partition configured for attachment to the worksurface.

The present invention further relates to a workstation having a primary worksurface configured for rotation and coupled to a base configured for rotation, a hub having an input utility carrier from a utility from a utility supply source, and an output utility carrier operatively coupled to the input utility carrier and communicating between the hub and the primary worksurface for transmitting utilities from the utility supply source to the primary worksurface.

DETAILED DESCRIPTION OF PREFERRED AND OTHER EXEMPLARY EMBODIMENTS

Figure 1A:
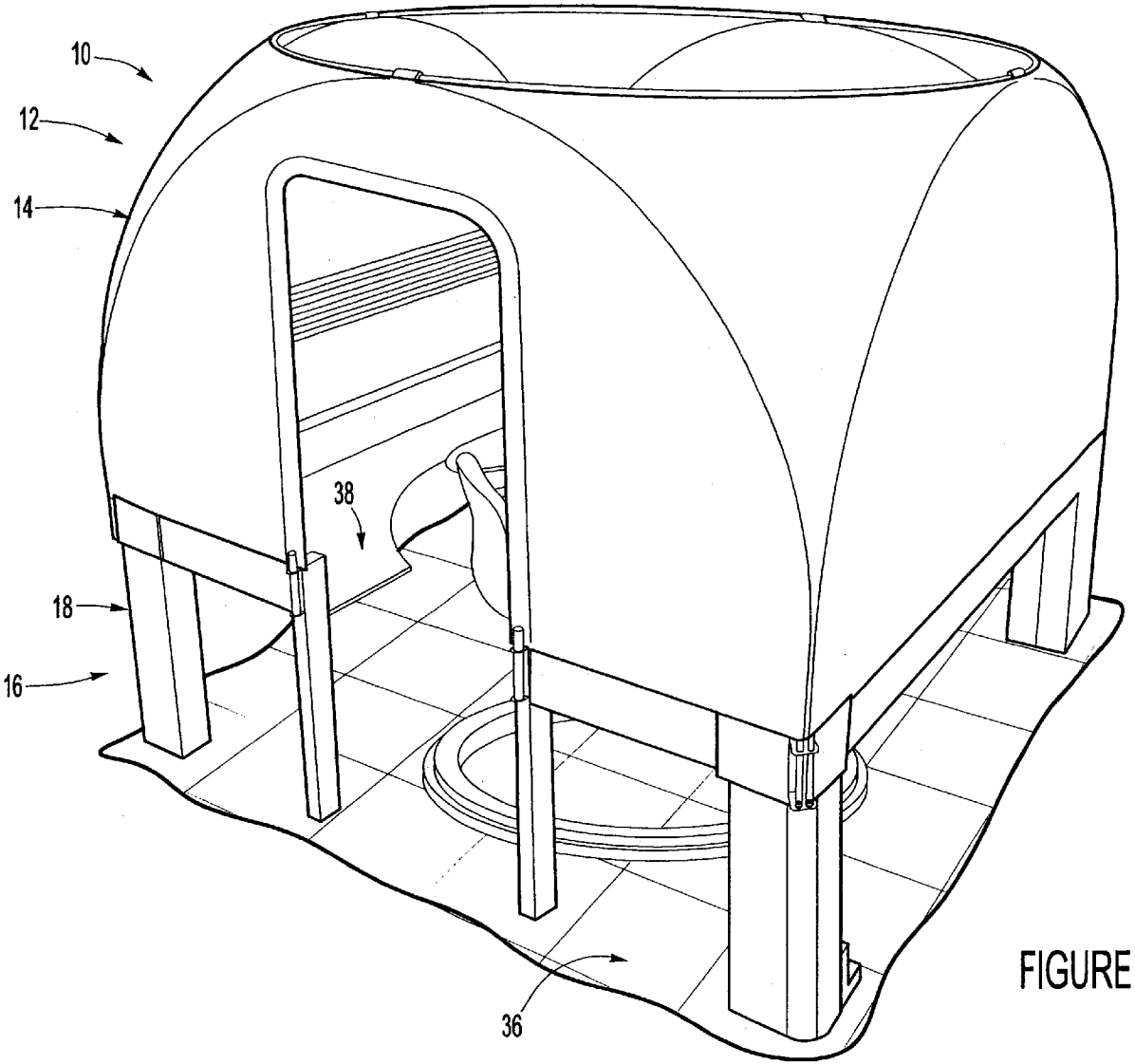
FIG. 1A is a perspective view of the workstation according to a preferred embodiment.
Figure 1B:
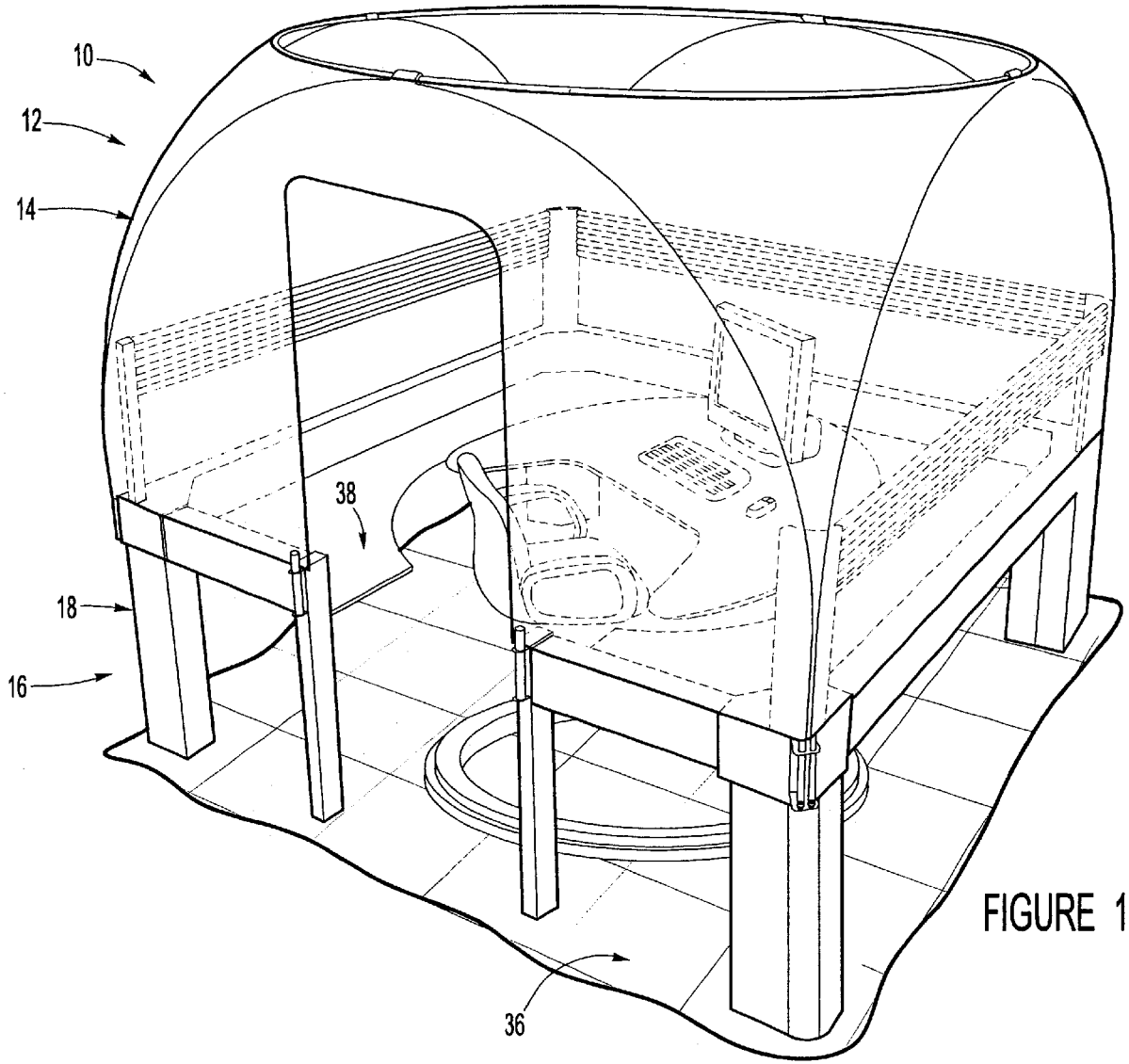
FIG. 1B is a perspective view of the workstation according to a preferred embodiment.

Referring to FIGS. 1A and 1B, a work station 12 having a cover 14 is shown according to a preferred embodiment. An exemplary workstation having a cover is shown in U.S. patent application Ser. No. 724,923 titled "WORK ENVIRONMENT" filed Nov. 28, 2000, the disclosure of which is hereby incorporated by reference. Workstation 12 is particularly suited for an individual worker and includes a structural frame system 16 having a base frame assembly 18 and a cover frame assembly 20. Base frame assembly may be secured to a floor by connectors allowing workstation to be flexibly located within work environment 10.

Figure 2:
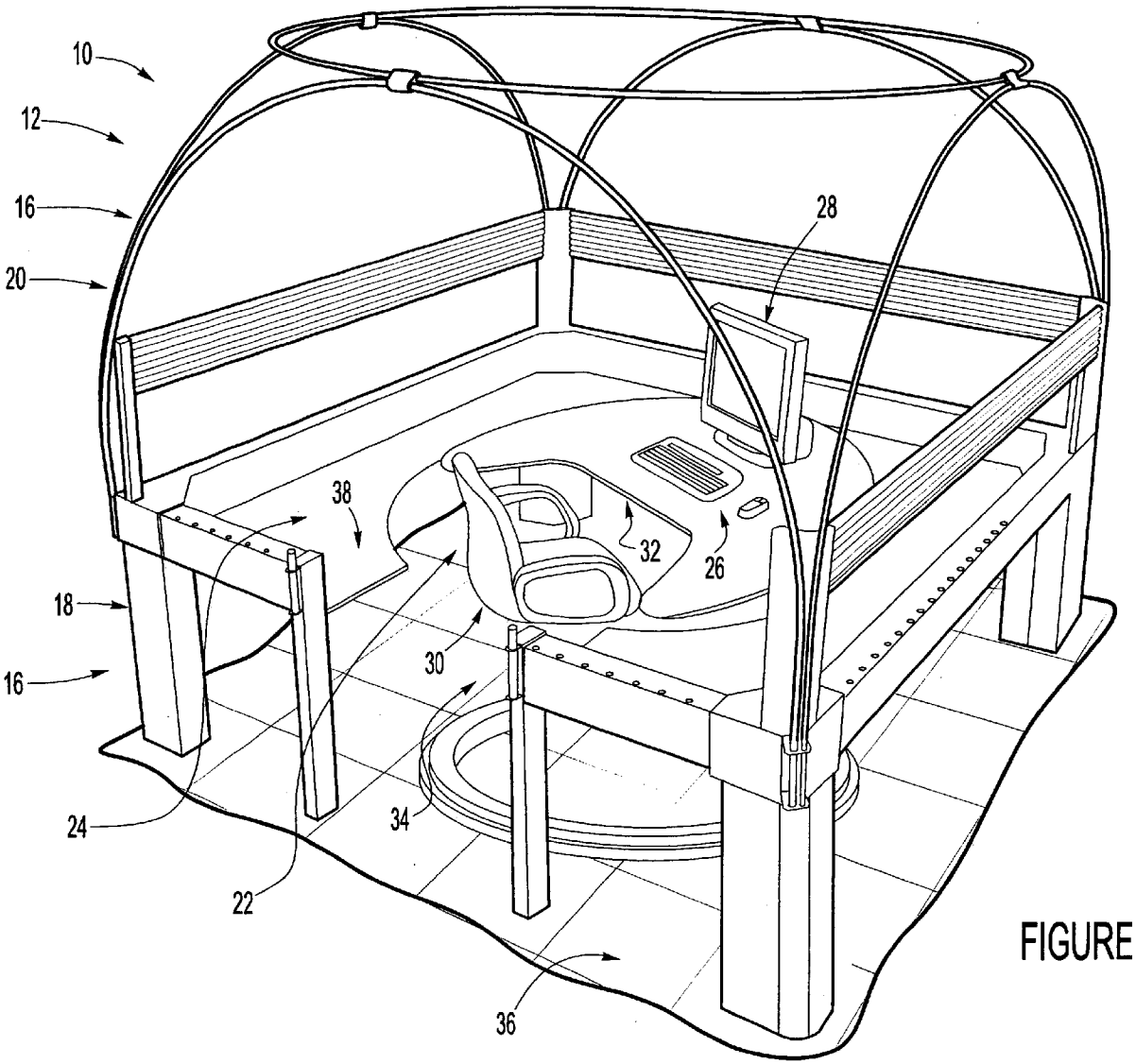
FIG. 2 is a perspective view of the primary workstation and the secondary workstation according to a preferred embodiment.

Referring to FIG. 2, workstation 12 having a primary workstation 22 and a secondary workstation 24 are shown according to a preferred embodiment. Primary workstation 22 may have a primary worksurface 26 for supporting primary work devices or appliances 28 (e.g. computing devices, telephones, displays, etc.) and a seat 30 coupled to a base 50 (shown in FIG. 5) for supporting a user. Primary worksurface 26 has a circular shape having rounded edges, with a recess 32 for positioning a user to access primary work devices or appliances 28 on primary worksurface 26. According to a particularly preferred embodiment, primary worksurface 26 may have a circular radius of approximately 32 inches. Secondary worksurface 38 may be shaped having an interior circular aperture with rounded edges and sized for receiving the primary workstation 22, and a passageway 34 for access and egress from primary workstation 22. Primary workstation 22 may be rotatable in either direction relative to, and within, secondary workstation 24, while secondary workstation 24 may be fixed relative to floor 36, so that the orientation of a user to primary worksurface 36 and access to primary work appliances 28 remains constant, while the orientation of a user to the secondary workstation 24 rotates to the same degree as the rotation of primary workstation 22 to permit selective access to a plurality of secondary work appliances. The rotatable relationship between primary workstation 22 and secondary workstation 24 increases the density of work appliances accessible to a user by allowing continuous reference to primary work appliances 28 while selectively referencing a multitude of secondary work appliances. According to a particularly preferred embodiment, the aperture in secondary worksurface 38 may have a radius of approximately 33 inches. Rotation of primary workstation 22 may be accomplished by a motorized drive mechanism (e.g. "bull gear" etc. —not shown) for providing power-assisted rotation of primary worksurface 26 or manually by a user pushing his/her feet against a stationary cover 52 (shown in FIG. 5) to impart a rotational force on rotating ring 60 (shown in FIG. 5). Secondary workstation 24 may include a plurality of secondary work devices or appliances (e.g. multiple computing devices, monitors, displays, shelves, storage devices, etc. —not shown) located along one or more interior sides of secondary worksurface 38 so that a user may selectively obtain visual access of a particular secondary work device, while maintaining constant alignment with one or more primary work appliances 28 by selectively rotating primary workstation 22. Increasing the density of accessible work appliances by a "workstation within a workstation" improves the efficiency of floor space utilization within work environment 10.

Figure 3:
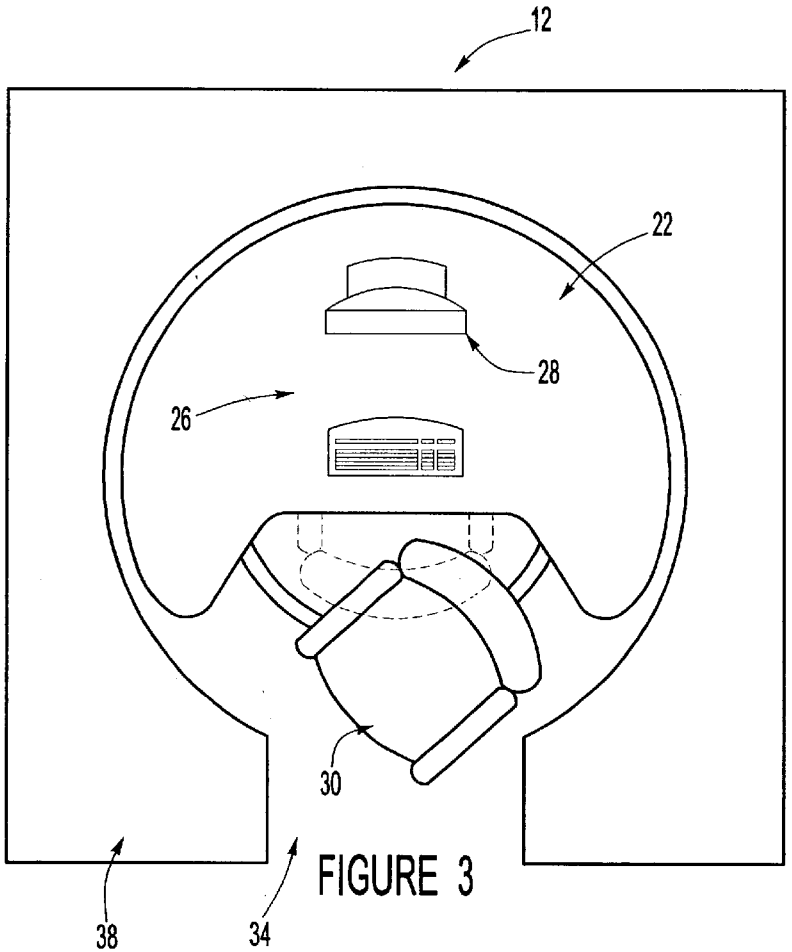
FIG. 3 is a top plan view of the primary workstation and the secondary workstation according to a preferred embodiment.

Referring to FIG. 3, an access orientation to primary workstation 22 is shown according to a preferred embodiment. Primary workstation 22 may be selectively rotated in either direction to an "open" position where the rotational position of seat 30 is aligned with passageway 34, and seat 30 may swivel for allowing access and egress from primary workstation 22.

Figure 4:
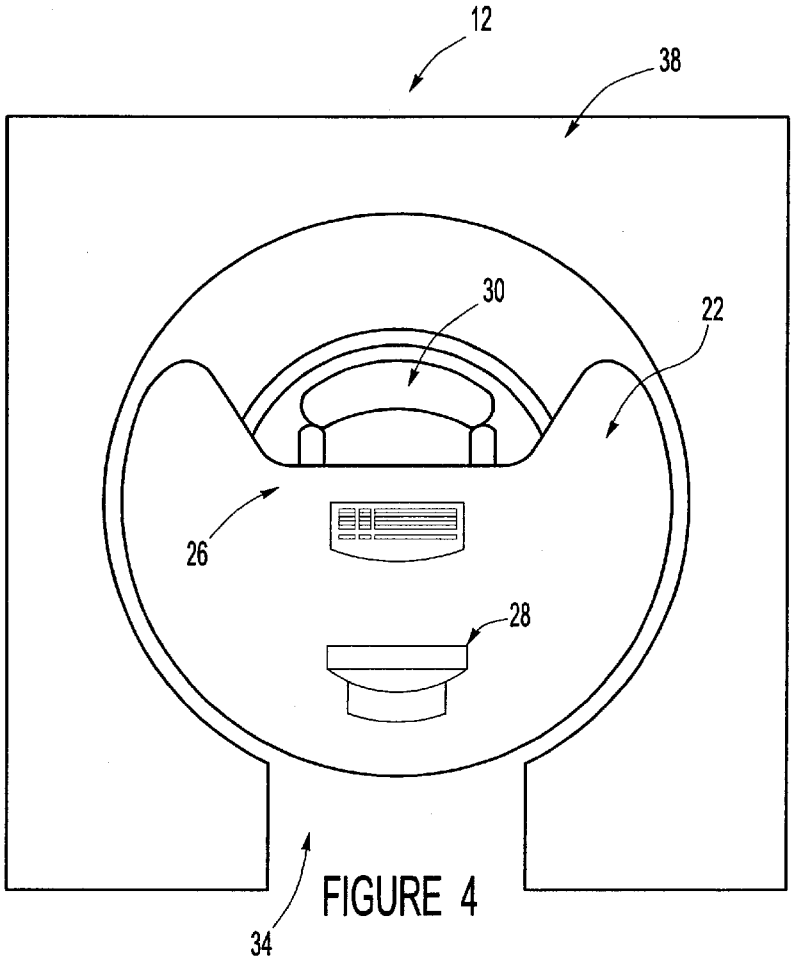
FIG. 4 is a top plan view of the primary workstation and the secondary workstation according to a preferred embodiment.

Referring to FIG. 4, a restricted orientation of primary workstation 22 is shown according to a preferred embodiment of the present invention. When in use, primary workstation 22 may be selectively rotated in either direction to a "closed" position where the rotational position of seat 30 is aligned opposite from passageway 34 for a user to prevent access and egress from primary workstation 22.

Figure 5:
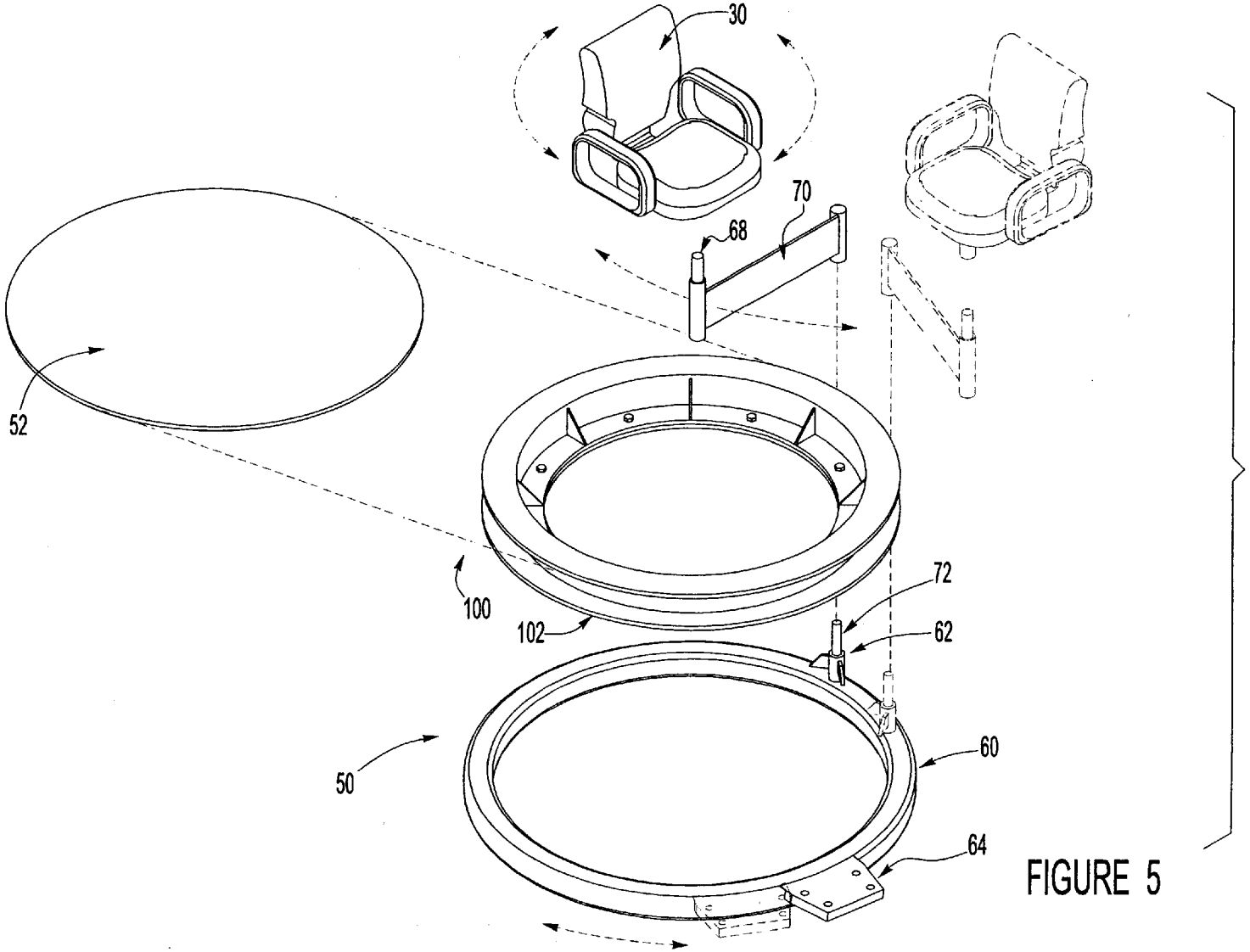
FIG. 5 is an exploded perspective view of the base according to a preferred embodiment.

Referring to FIG. 5, base 50 and swiveling seat 30 are shown according to a preferred embodiment. Base 50 includes two concentric ring structures. A first ring structure may be an outer rotating ring 60 having a bracket 62, a base plate 64, a first utility junction 66 (shown in FIG. 7A). A second ring structure may be an inner stationary ring 100 which may be fixed to floor 36 or to a platform (not shown) and having a second utility junction 134 (shown in FIG. 7A) and a removable cover 52, whereby outer rotating ring 60 may be movably coupled to inner stationary ring 100. A motorized drive mechanism (not shown) may be coupled to rotating ring 60 and stationary ring 100 to provide a power-assisted method for rotating the primary workstation 22. Seat 30 includes a seat support rod 68 having a first end rotatably coupled to a bottom surface of seat 30 and a second end received in a first end of a link 70. Link 70 has a second end for pivotally receiving a first end of a mounting support rod 72. Mounting support rod 72 has a second end coupled to bracket 62 that is attached to rotating ring 60. According to a particularly preferred embodiment, link 70 may be approximately 17 inches long and seat 30 may have three independent degrees of rotation. A first degree of rotation may allow seat 30 to swivel about an axis defined by a seat support rod 68 coupled to a bottom surface of seat 30. A second degree of rotation may allow seat 30 to pivot via link 70 about an axis defined by mounting support rod 72, coupled to bracket 62 that may be attached to rotating ring 60. A third degree of rotation may allow seat 30 to travel along a circular path defined by rotating ring 60. According to an alternative embodiment, the base may have an inner rotating ring and outer stationary ring to facilitate alternative utility interface devices for conveying utilities from a supply source to the primary worksurface.

Figure 6A:
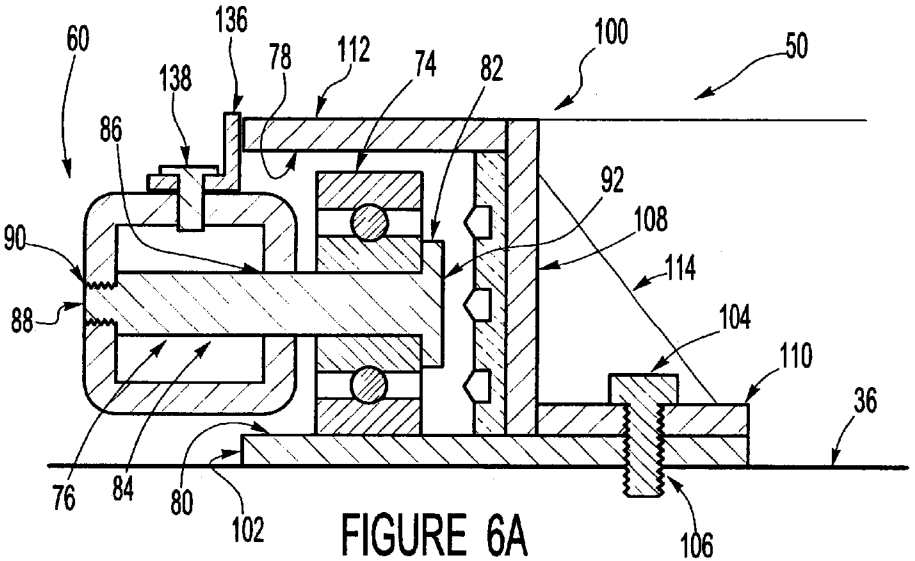
FIG. 6A is a sectional view of the base according to a preferred embodiment.

Referring to FIG. 6A, rotating ring 60 is shown according to a preferred embodiment. Rotating ring 60 is sized to concentrically surround a circular wall 108 of stationary ring 100 and has a plurality of bearings 74 spaced at equal increments and mounted around the inner circumference of rotating ring 60 by a plurality of shafts 76. Bearings 74 are guided by the exterior surface of stationary ring 100 to allow the rotating ring 60 to roll in a circular path about the rotating ring's central axis. Rotating ring is confined in a horizontal rotation plane by an upper track 78 and a lower track 80 defined by the structure of stationary ring 100. According to a particularly preferred embodiment, rotating ring 60 includes a hollow steel tube having a square cross section approximately 1¼ inches high, 1¼ inches wide, and a wall thickness approximately 3/16 inch. The hollow steel tube may be formed and welded into a circular ring having an internal radius approximately 19.46 inches. A plurality of shafts 76 having a circular cross section and a shoulder 82 at an interior end may be circumferentially spaced and rigidly attached to rotating ring 60. Shaft 76 may be rigidly attach to rotating ring 60 by having a shank 84 extending through an aperture 86 located on an interior wall of rotating ring 60, and a threaded end portion 88 that engages a tapped aperture 90 located on an exterior wall of rotating ring 60, whereby shank 84 is positioned horizontally and extends radially inward approximately 11/16 inch from aperture 86 at the vertical center of the interior wall of rotating ring 60. According to a particularly preferred embodiment, shaft 76 may be an allen-head shoulder-screw having a head 92, a ⅜ inch shank diameter and a 5/16 inch threaded diameter, and spaced at approximately thirty (30) degree increments around the circumference of rotating ring 60. In other alternative embodiments, the rotating ring may be composed of any structural material and cross sectional shape capable of forming a ring and suitably sized for supporting and rotating the primary workstation, and the shafts may have any suitable form for mounting the bearings to the rotating ring.

Referring further to FIG. 6A, bearing 74 and shaft 76 are operationally engaged according to a preferred embodiment. Bearings 74 have an inner race with an inside diameter corresponding to the outside diameter of shank 84 and are mounted on each of the plurality of shafts 76 whereby bearing 74 is laterally captured between head 92 and the interior wall of rotating ring 60. A plurality of guides 136 are attached to a top surface of rotating ring 60 by fastener 138 for sliding engagement along an exterior surface of circular top 112 to concentrically guide rotating ring 60 around stationary ring 100. Guides 136 provide a reduced friction interface to promote sliding engagment between guides 136 and circular top 112. According to a particularly preferred embodiment guides 136 are approximately 3/16 inch thick and spaced at 30 degree radial increments around rotating ring 60 and made from an ultra high molecular weight (UHMW) polyethylene or Delrin which is commercially available from the Du Pont Corporation of Wilmington, Del. Alternatively, guides 136 may be made from angle steel approximately 3/16 inch thick. According to an alternative embodiment, a plurality of bumper caps may be press-fit over the outside of head of each of the plurality of shafts, the bumper cap having a center hole for accessing the Allen-socket in the head, and made from a resilient, low friction material such as Delrin, Nylon or plastic for slidably engaging the stationary ring. The bumper cap provides a surface for sliding along an exterior surface of the stationary ring to concentrically guide the rotating ring around the stationary ring. According to a particularly preferred embodiment, bearing 74 is spaced at 30 degree radial increments around rotating ring 60 and is a commercially available roller bearing having an internal diameter approximately 3/8 inch and an external diameter approximately 1½ inches such as those available from the McMaster Carr Supply Company of Chicago, Ill. The plurality of bearings may provide rotational movement of rotating ring 60 about a central axis. According to other alternative embodiments, bearings of any suitable size and style may be used and may be coupled to the rotating ring in any suitable manner to provide concentric rotation. Alternative guide configurations (e.g. horizontally oriented rollers, channel-shaped bearing tracks, etc.) or alternative bumper cap materials may be substituted to prevent friction or binding between the rotating ring and the stationary ring. According to other alternative embodiments, a stationary ring may surround an inner rotating ring to facilitate alternative utility interface embodiments between the rotating ring and the stationary ring.

Further referring to FIG. 6A, stationary ring 100 is shown according to a preferred embodiment of the present invention. Stationary ring 100 includes a flat, ring-shaped circular base 102 that is attachable to floor 36 by fasteners 104 (shown as screws in FIG. 6A) through a plurality of fastener apertures 106 spaced at equal radial increments and provides a lower track 80 upon which bearings 74 may ride when a downward force from primary workstation 22 exists at a particular bearing. According to a particularly preferred embodiment, circular base 102 is made from plate steel approximately 3/16 inch thick and having an internal radius approximately 16.97 inches and an external radius approximately 19.87 inches, with fastener holes approximately 5/16 inch in diameter located at approximately 45 degree radial increments around circular base 102 at an approximate 17.68 inch radius. According to other alternative embodiments, circular base may be made from any suitable material and have other dimensions appropriate for supporting a rotating device and may be attached to a floor by lightweight quick-connectors to improve the mobility of primary workstation 22 to other locations within work environment 10.

Referring further to FIG. 6A, a vertical circular wall 108 may be attached to, and project upward from, base 102 defining a fixed circle about which rotating ring 60 may concentrically rotate. According to a particularly preferred embodiment, vertical circular wall 108 may have an internal radius of approximately 18 3/16 inches, and having a vertical height approximately 1¾ inches, formed from plate steel approximately 3/16 inch thick. A flat, lateral support ring 110 may be provided to concentrically overlap an inner portion of circular base 102 and circumferentially abut a lower interior edge of vertical circular wall 108 to provide lateral support for vertical circular wall 108. Lateral support ring 110 may have a plurality of fastener apertures provide to align with fastener apertures 106 in circular base 102. According to a particularly preferred embodiment, lateral support ring 110 may be made from plate steel approximately 3/16 inch thick and have an interior diameter of approximately 16.98 inches and an exterior diameter of approximately 18.18 inches. According to other alternative embodiments, circular wall and lateral support ring may be made of any suitable material and have other dimensions appropriate for supporting a rotating device.

Referring further to FIG. 6A, a flat, ring-shaped circular top 112 may be rigidly attached to, and project horizontally outward from a top end of circular wall 108, to provide an upper track 78 upon which bearings 74 may ride when an upward force from primary workstation 22 exists at a particular bearing. A "lifting" or upward force on a portion of rotating ring 60 may exist if the center of mass of the primary workstation is shifted to a point outside of rotating ring 60 such as may occur when a user sitting in seat 30 swivels outside of rotating ring 60. Circular top 112 restrains such upward forces and improves the stability of primary workstation 22 under such operating conditions. According to a particularly preferred embodiment, circular top 112 may be formed from plate steel approximately 3/16 inch thick having an internal radius of approximately 18.37 inches and external radius of approximately 19.87 inches, and positioned to provide an approximate 1 9/16 clearance with circular base 102 to provide a raceway for bearings 74. The outside diameter of bearing 74 may be sized to provide a small working clearance between upper track 78 and lower track 80, whereby bearing 74 is in contact with only one of the upper track 78 or the lower track 80 at any time. Upper track 78 and lower track 80 may provide parallel ring-shaped surfaces within which bearings 74 ride to accommodate the asymmetrical loading that may be applied to primary workstation 22 by the weight and location of a user and primary work appliances 28. According to other alternative embodiments, the circular top may be made of any suitable material and have other shapes or dimensions appropriate for providing an upper track for maintaining the rotating ring in a horizontal rotational plane.

Figure 6B:
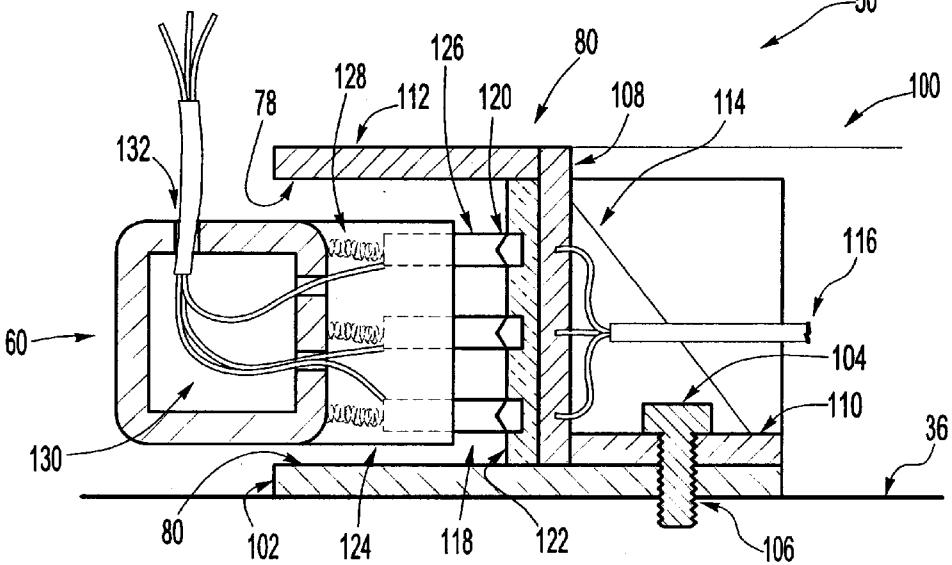
FIG. 6B is a sectional view of the base according to a preferred embodiment.

Referring further to FIG. 6A, a plurality of gussets 114 may be circumferentially spaced, and rigidly attached, to the radially inward portions of lateral support ring 110 and circular wall 108 to increase the structural rigidity of stationary ring 100. According to a particularly preferred embodiment, gussets 114 are circumferentially spaced at 30 degree radial increments around the interior of stationary ring 100, and shaped as a right triangle having a horizontal leg dimension approximately 1 inch long and a vertical leg approximately 1½ inches long, and formed from plate steel approximately 3/16 inch thick. According to a particularly preferred embodiment, base 102, vertical wall 108, circular top 112, lateral support ring 110 and gussets 114 are attached by welding, but may be joined by any suitable means appropriate for assuring the strength and durability of the assembly. Cover 52 may be sized to fit within, and enclose, the space inside of vertical wall to improve aesthetic appeal and provide a resting place and a manual rotation push-off surface for a user's feet, and may be composed of any suitable material having sufficient strength to support the loading applied by a user. Referring to FIG. 6B, a utility (e.g. power, voice and data communications, etc.) interface is provided for delivering utilities from stationary ring 100 to rotating ring 60 without the use of interconnecting wires that may restrict rotational motion, according to a preferred embodiment of the present invention. Utility carriers 116 are routed from a supply source (not shown) to a utility junction 66 (shown in FIG. 7A) on stationary ring for delivering utilities to a commutator 118 surrounding the outer surface of circular wall 108. According to a particularly preferred embodiment, commutator 118 may be similar to commercially available commutator type 1988 manufactured by Fabricast Inc. of South El Monte, Calif. According to an alternative embodiment, commutator 118 may have three electrically conductive rings 120 vertically spaced along the outer surface of circular wall 108 and electrically isolated by an insulating layer 122 to prevent shorting the utility supply source (not shown) to ground through stationary ring 100. A first conductive ring may be designated as electrically positive and connected to a positive lead of utility carrier 116. A second conductive ring may be designated as electrically negative and connected to a negative lead of utility carrier 116. A third conductive ring may be designated as electrically neutral and connected to a neutral lead of utility carrier 116. According to other alternative embodiments, the rotating ring and a commutator may be placed on the inside of a stationary ring to facilitate other utility interface embodiments.

Referring further to FIG. 6B, a utility interface is provided on rotating ring 60 for supplying utilities to rotating ring 60 unconstrained by interconnecting wires according to a preferred embodiment of the present invention. A brush holder 124 may be attached to the interior wall of rotating ring 60 and holds three electrically conducting brushes 126 that are maintained in contact with conducting rings 120 by a set of springs 128 in brush holder 124, whereby utilities can be transmitted through rotating ring 60 without the use of interconnecting wires. Brushes 126 may be attached to insulated conducting leads 130 extending through an aperture 132 in the inner wall of rotating ring 60 and traveling through the interior cavity of rotating ring 60 to a utility junction 134 (shown in FIG. 7A) for distribution of utilities to primary work devices 28.

According to alternative embodiments, utilities may be transmitted from the stationary ring to the rotating ring by connecting a long utility carrier (not shown) between the rotating utility junction and the stationary utility junction, whereby the rotating ring may travel through a number of revolutions determined by the length of the utility carrier (not shown) as the utility carrier wraps around the base. According to another alternative embodiment, utilities may interface between the stationary ring and the rotating ring by connecting a short utility carrier that limits rotational travel to less than 360 degrees; whereby when the rotational travel limit is reached, the primary workstation may be rotated in the opposite direction. According to another alternative embodiment, utilities may interface between the stationary ring and the rotating ring by an infrared transmitter and receiver or by any other wireless interface method. According to further alternative embodiments, a commutator and/or rotating ring may be placed inside a stationary ring to provide alternative methods for transmitting utilities from a supply to a primary worksurface.

Figure 7A:
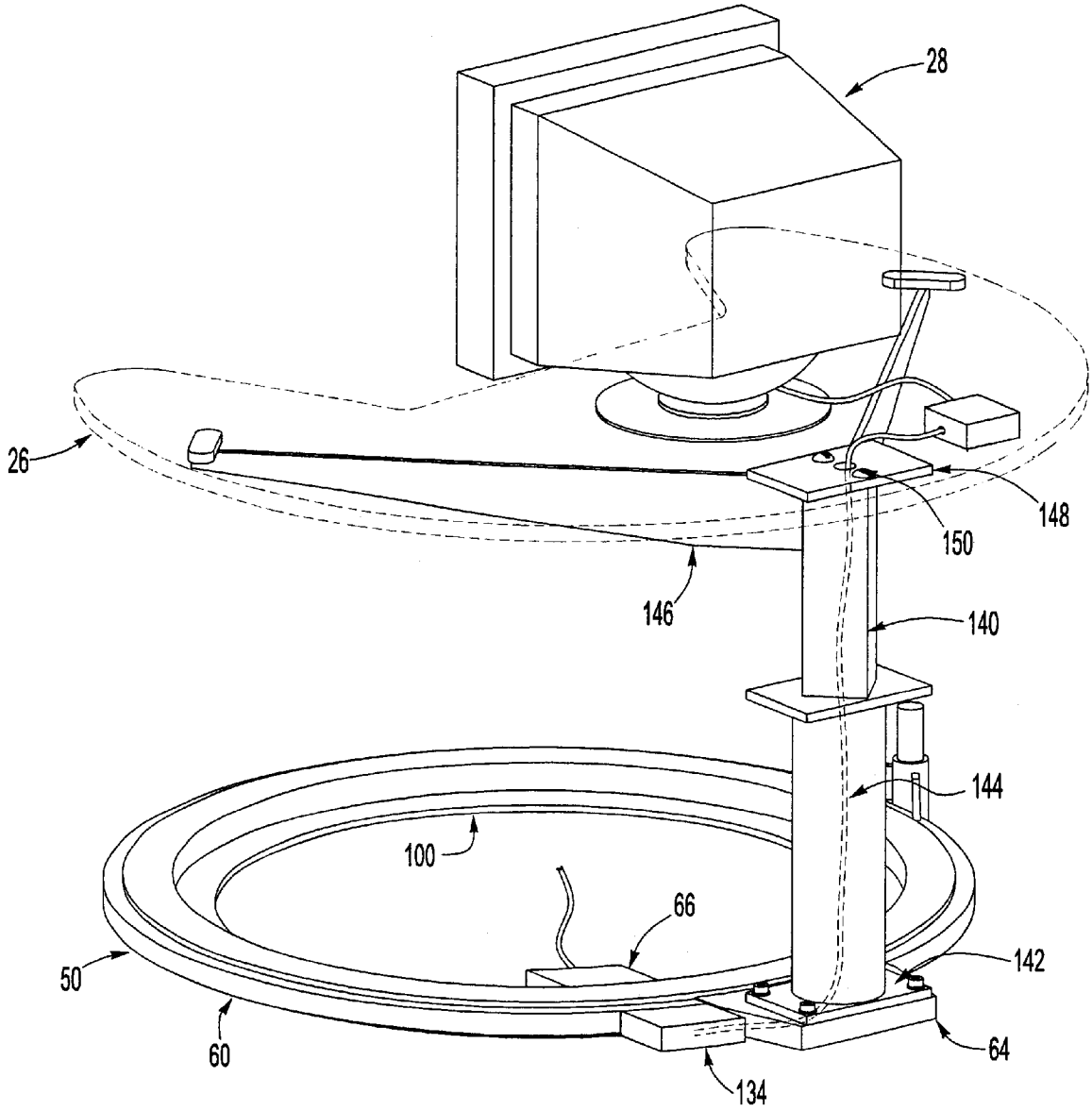
FIG. 7A is a perspective view of the primary workstation according to a preferred embodiment.

Referring to FIG. 7A, a support pedestal 140 for primary worksurface 26 is shown according to a preferred embodiment of the present invention. Pedestal 140 may have a base 142 that is attached to base plate 64 on rotating ring 60, whereby pedestal 140 and primary worksurface 26 are attached to, and rotate with, rotating ring 60. According to a particularly preferred embodiment, base 142 may be attached to base plate 64 with commercially available threaded fasteners. Pedestal 140 may have a hollow interior for routing utility carriers 144 from utility junction 134 located on rotating ring 60 for supplying utilities to primary worksurface 26, which may include a utility interface (shown as a box) providing user access to power voice and data communications. Pedestal 140 may have any suitable cross sectional shape (shown as a cylinder interfacing with a square tube in FIG. 7A) for supporting primary worksurface 26 and for routing utility carriers 144. In a particularly preferred embodiment, pedestal 140 may be composed of steel or aluminum, but may be composed of any other suitable material in alternative embodiments. One or more arms 146 may extend from pedestal 140 to support the underside of primary worksurface 26. In a particularly preferred embodiment, two arms 146, spaced approximately 90 degrees apart, may extend from pedestal 140; the outward end portions of arms 146 may be removably attached to the underside of primary worksurface 26 by fasteners (not shown). Pedestal 140 may have a top plate 148 configured horizontally and attached to a top end of pedestal 140 for supporting primary worksurface 26 and may be removably attached to primary worksurface 26 by fasteners 150. In a particularly preferred embodiment, pedestal 140 may include a height adjustment mechanism (not shown) similar to a LAD 120 actuator type AE16-01G11M20L commercially available from Warner Electric of South Beloit, Ill. According to other alternative embodiments, any suitable power or manual height adjustment mechanism may be provided to selectively change the height of the primary worksurface.

Figure 7B:
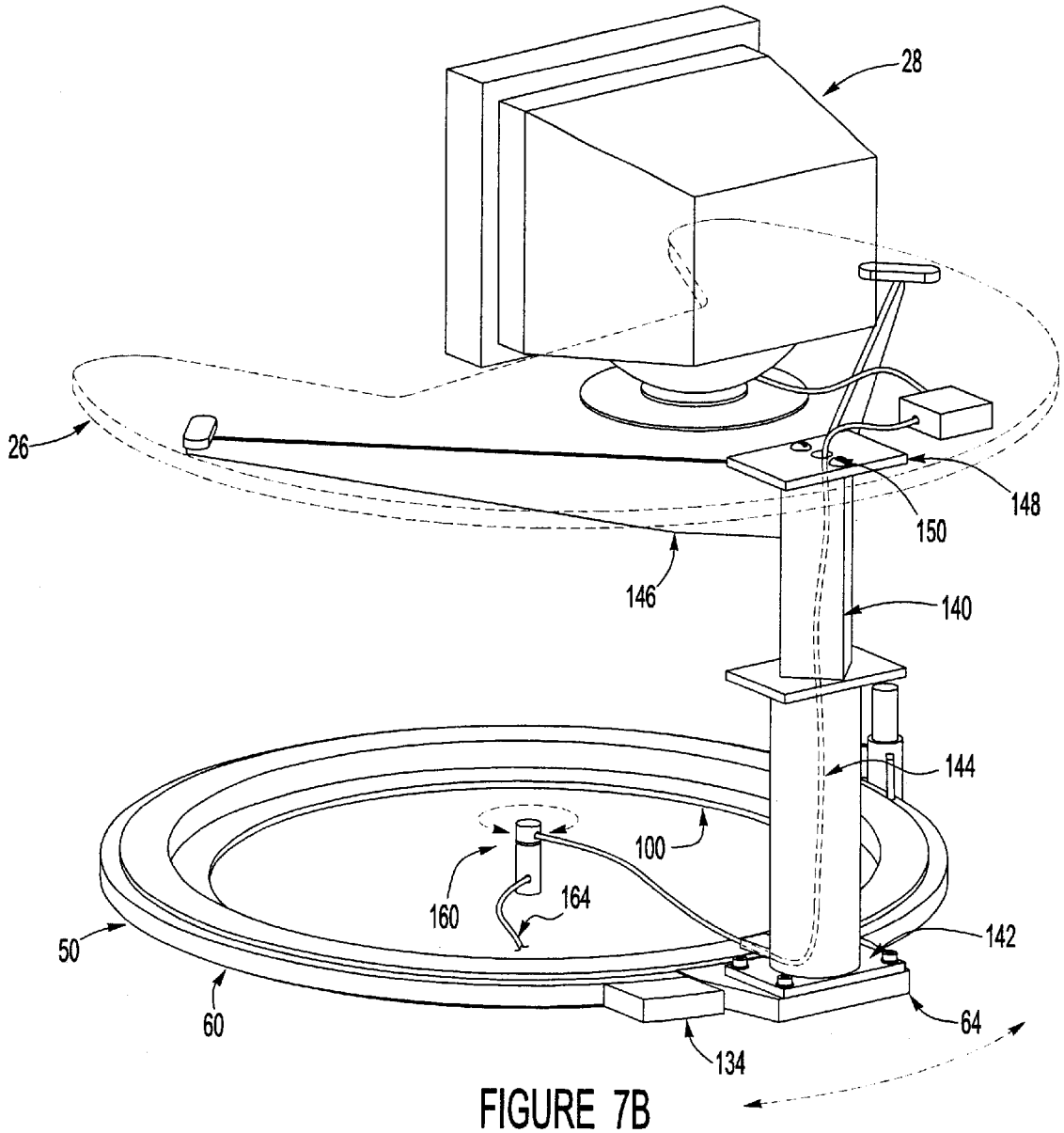
FIG. 7B is a perspective view of the primary workstation according to an alternative embodiment.
Figure 7C:
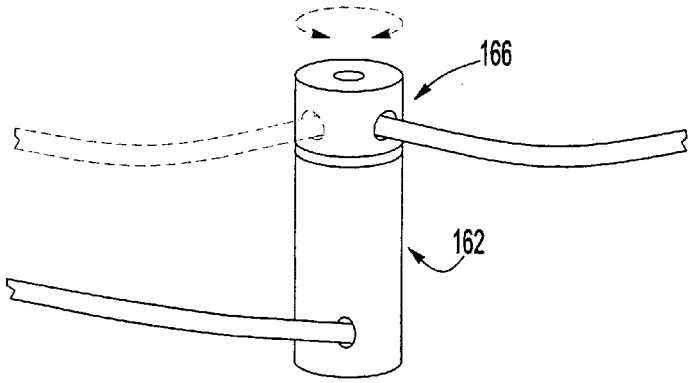
FIG. 7C is a perspective view of the hub according to an alternative embodiment.

Referring to FIGS. 7B and 7C, a rotating utility carrier interface or hub 160 for delivering utilities from a supply source (not shown) to primary worksurface 26 via pedestal 140 is shown according to a preferred embodiment. Hub 160 includes a lower stationary portion 162 for receiving an input utility carrier 164 from a supply source and may be positioned in axial alignment with the center axis of rotating ring 60. In a particularly preferred embodiment, input utility carrier may be routed beneath a floor (not shown) and extend through the floor for coupling to hub 160. Alternatively, base 50 may be elevated on a pedestal, island or support ring (not shown) having an aperture for routing an input utility carrier to hub 160. Hub 160 also includes an upper rotating portion 166 operatively coupled to the lower stationary portion 162 and an output utility carrier 168 that may be routed for supplying utilities to primary worksurface 26. Operative coupling between hub lower portion 162 and hub upper portion 166 allows hub upper portion 166 and output utility carrier 168 to rotate with rotating ring 60 without twisting output utility carrier 168. According to an alternative embodiment, the hub may be any rotating interface device capable of operatively coupling an input stationary utility carrier to an output rotating utility carrier or passing through a single utility carrier from input to output (to the primary worksurface). According to other alternative embodiments the rotating ring may be configured for installation inside of the stationary ring whereby the upper hub portion and the output utility carrier may be rotatably coupled to the primary worksurface via the rotating ring without requiring an interface on the stationary ring. (not shown).

Figure 7D:
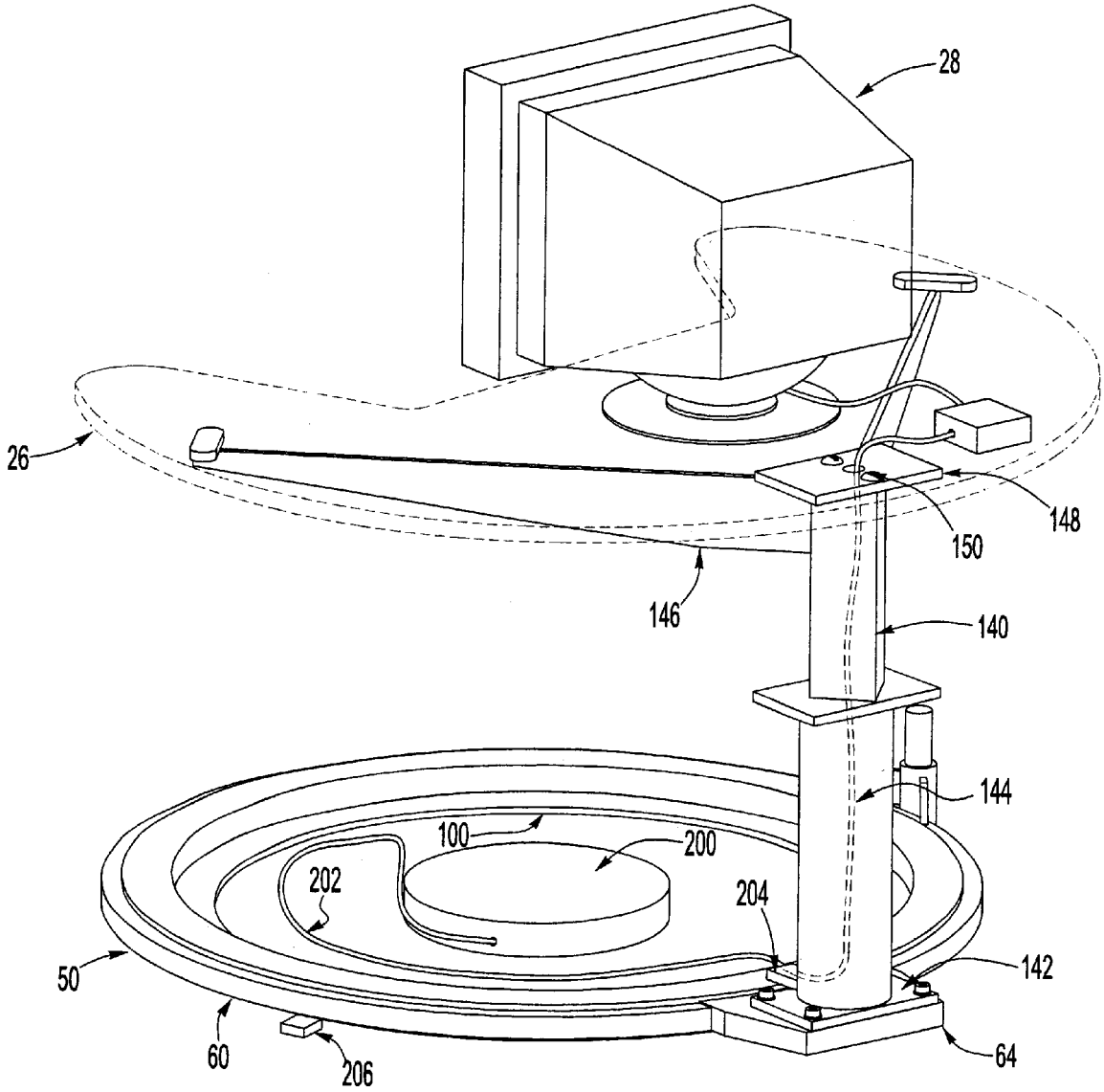
FIG. 7D is a perspective view of the primary workstation according to an alternative embodiment.

Referring to FIG. 7D, a stationary utility carrier interface or hub 200 for delivering utilities from a supply source (not shown) to primary worksurface 26 is shown according to a preferred embodiment. Stationary hub 200 may be positioned within base 50 and provide a supporting surface for cover 52 (not shown) with sufficient clearance above base 50 to allow utility carrier 202 to travel from hub 200 to utility junction 204 on rotating ring 60. A first end of utility carrier 202 having sufficient length to permit 360 degree rotation of primary worksurface 26 is coupled to hub 200, and a second end of utility carrier 202 is routed to primary worksurface 26 via utility junction 204. Travel stop 206 is positioned adjacent to base 50 to limit the primary workstation 22 to 360 degree rotation relative to base 50.

Figure 9:
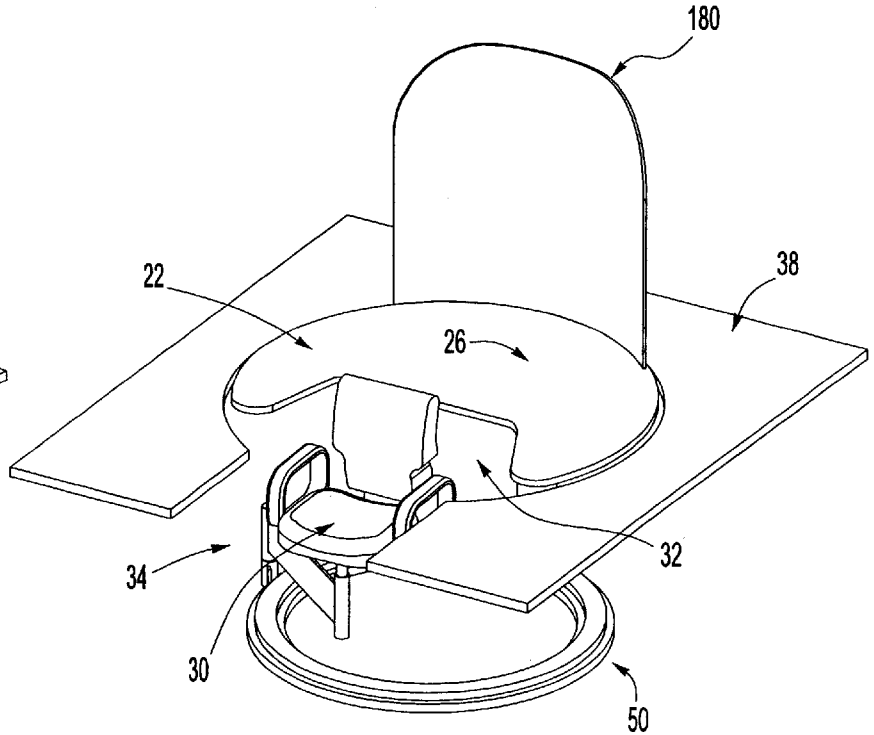
FIG. 9 is a perspective view of the privacy panel according to a preferred embodiment.
Figure 8:
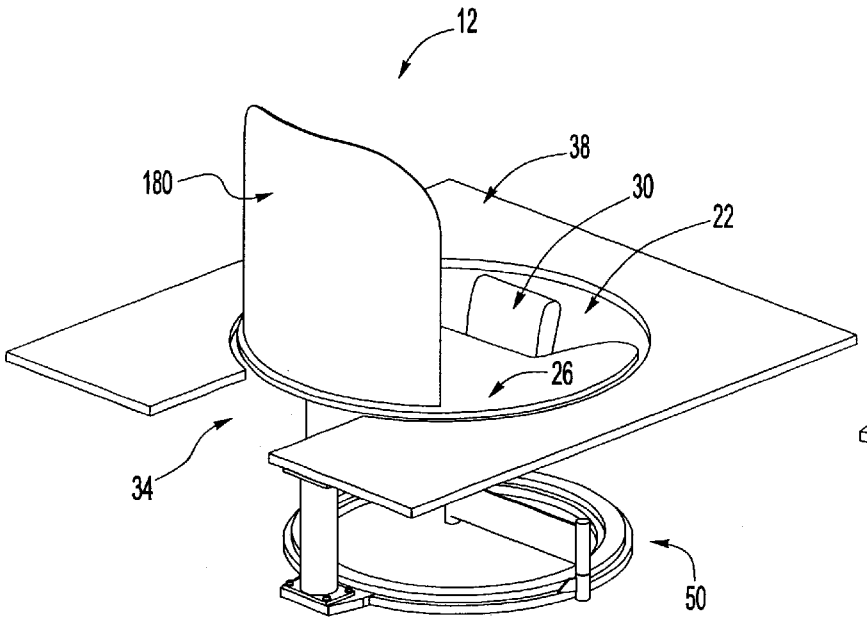
FIG. 8 is a perspective view of the privacy panel according to a preferred embodiment.

Referring to FIGS. 8 and 9, a portable partition or privacy panel 180 may be included in primary workstation 22 according to a preferred embodiment of the present invention. Privacy panel 180 improves the sense of enclosure and privacy for a user by restricting visual access into primary workstation 22 and may also serve as a display surface allowing a user to maintain continuous focus on reference materials. Privacy panel 180 may be removably attached to primary worksurface 26 opposite from recess 32 and have a concentrically curved surface, corresponding to the circular perimeter of primary worksurface 26, that extends vertically upward from the top surface of primary workstation 22. Primary workstation 22 may be rotated to a closed position (as shown in FIG. 8) where access to the primary workstation 22 is restricted and privacy panel 180 restricts visual access from a user to passageway 34 to reduce distractions. Primary workstation 22 may also be rotated 180 degrees to an open position (as shown in FIG. 9) where seat 30 is aligned with passageway 34 to provide access and egress for a user. In a particularly preferred embodiment, privacy panel is made of a material suitable for receiving thumbtacks, pins and the like and is approximately ¾ inch thick. According to other alternative embodiments, the privacy panel may be any suitably lightweight and rigid material and may be attached to the primary workstation using any appropriate fastening method.

Figure 10:
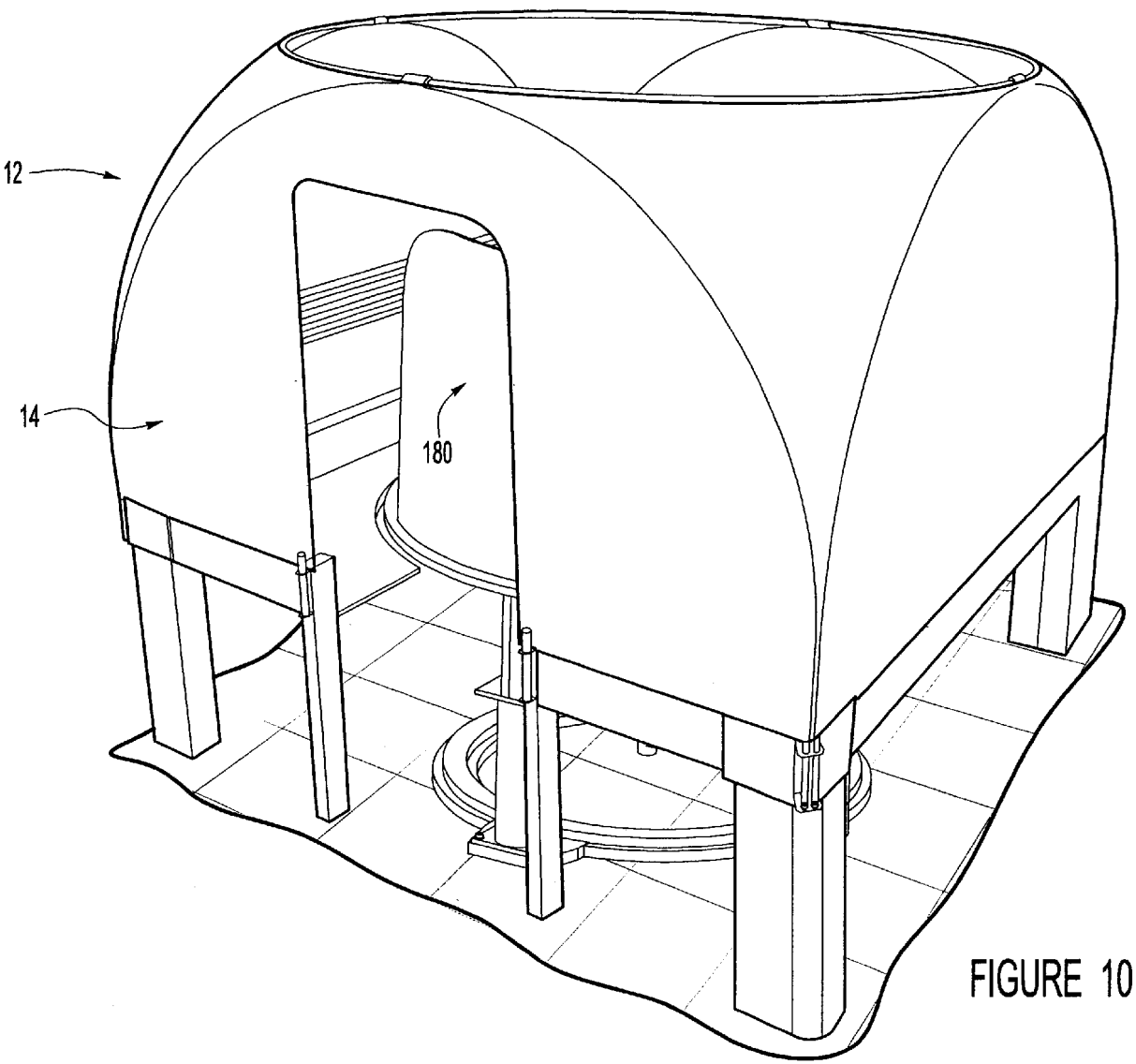
FIG. 10 is a perspective view of the workstation and privacy panel according to a preferred embodiment.

Referring to FIG. 10, privacy panel 180 and workstation 12 with cover 14 are shown according to a preferred embodiment of the present invention. Primary workstation 22 including privacy panel 180 (as shown in FIGS. 8 and 9) may be used in conjunction with workstation 12 and with cover 14 (as shown in FIGS. 1A and 1B) to provide a greater degree of privacy by restricting all visual access to primary workstation 22 when primary workstation 22 is rotated to a closed position.

Figure 11:
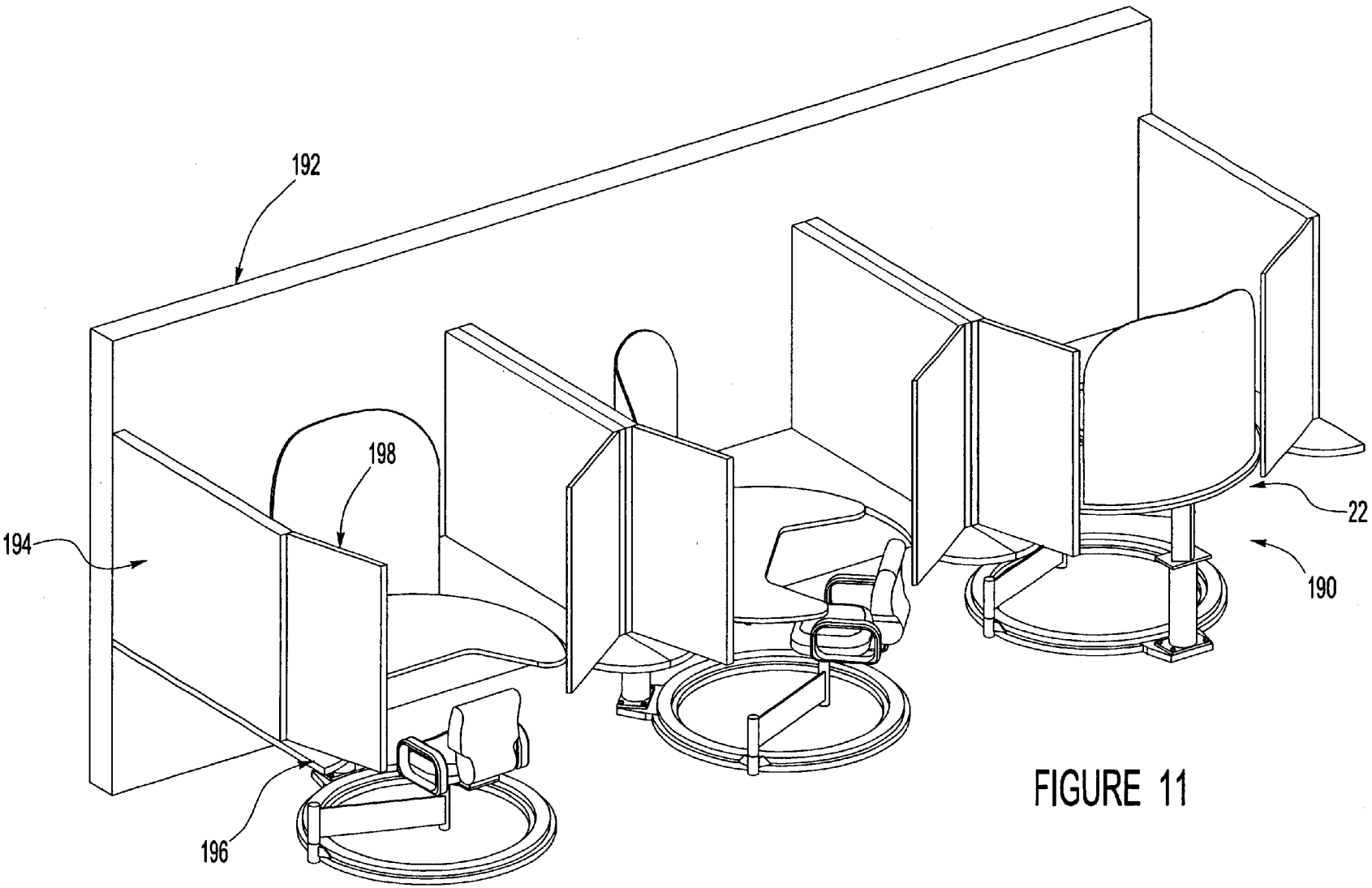
FIG. 11 is a perspective view of a cluster of workstations according to an alternative embodiment.

Referring to FIG. 11, a cluster of workstations 190 are shown according to an alternative embodiment of the present invention. A plurality of adjacent workstations 190 may be grouped together to improve available space utilization. A divider, partition or wall 192 may provide a common wall for a back portion of adjacent workstations 190, and a divider 194 may be placed along the shared sides of adjacent workstations 190 and on the outside wall of each end workstation 190. According to a particularly preferred embodiment, divider 194 may be approximately 3½ feet high and approximately 4 long and be made of a fabric covered panel material. Primary workstation 22 may include a removable privacy panel 180 (as shown in FIGS. 8 and 9) for reducing visual distractions to a user. Secondary worksurfaces 196 may surround a portion of primary workstation 22 to the extent that secondary work appliances (not shown) on secondary worksurface 196 would remain visually accessible to a user when primary workstation is rotated to a closed position. Extensions 198 may be included on dividers 194 to provide an additional degree of privacy when the primary workstation 22 and privacy panel 180 are rotated to a closed position. According to other alternative embodiments, the cluster of workstations may be grouped in any pattern suitable for meeting the space utilization needs of the work environment, and may or may not include privacy panels and dividers.

It is also important to note that the construction and arrangement of the elements of the workstation as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, a primary workstation configured for rotation may be used alone or in conjunction with other secondary structure providing selective access to a wide variety of appliances, furniture, operating stations etc. including storage systems, shelving, laboratory equipment, manufacturing or monitoring stations, reception stations, etc. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A workstation comprising:

a primary worksurface configured for rotation and coupled to a base configured for rotation;

a seat for a user coupled to the base;

a stationary secondary worksurface at least partially surrounding the primary worksurface;

wherein the primary worksurface is available to the user on rotation of the primary worksurface and the secondary worksurface is selectively available to the user on rotation of the primary worksurface.

2. The workstation of claim 1, wherein the primary worksurface is rotatable in a first direction and a second direction.

3. The workstation of claim 2 wherein the secondary worksurface has a passageway providing access to the primary worksurface.

4. The workstation of claim 3 wherein the primary workstation is selectively rotatable to an open position, whereby access to the primary workstation is available through the passageway.

5. The workstation of claim 4 wherein the primary workstation is selectively rotatable to a closed position, whereby access to the primary workstation through the passageway is restricted.

6. The workstation of claim 5 wherein the base is a turntable.

7. The workstation of claim 6 wherein the turntable comprises a stationary ring coupled to a rotatable ring.

8. The workstation of claim 7 wherein the seat is configured to rotate about a central axis of the seat.

9. The workstation of claim 8 wherein the seat is configured to pivot about a bracket attached to the rotatable ring.

10. The workstation of claim 9 further comprising a commutator for transmitting utilities from the stationary ring to the rotatable ring.

11. The workstation of claim 9 wherein a hub having a rotatable interface is provided for transmitting utilities from the a supply source to the rotating ring.

12. The workstation of claim 10 wherein the utilities are of the power, voice and data communications types.

13. The workstation of claim 12 wherein a pedestal is coupled to the rotatable ring.

14. The workstation of claim 13 wherein a worksurface is coupled to the pedestal.

15. The workstation of claim 14 wherein the pedestal has a hollow cavity for routing one or more utility carriers for transmitting utilities.

16. The workstation of claim 1 wherein the secondary worksurface is supported by a frame.

17. The workstation of claim 16 wherein the frame is attached to a floor.

18. The workstation of claim 1 wherein a utility carrier is interconnected between the base and a primary worksurface.

19. The workstation of claim 1 wherein a utility carrier is interconnectable from a source external to the base to at least one appliance on the primary worksurface.

20. The workstation of claim 1 wherein the utilities include at least one of power, voice and data.

21. The workstation of claim 1 wherein the primary worksurface is movable with respect to the base between an open position and a closed position with respect to an entry portal to the workstation.

22. The workstation of claim 1 wherein the primary worksurface is rotationally movable.

23. The workstation of claim 1 further comprising means for transmitting utilities from a utility supply source to the primary worksurface.

24. A workstation comprising:

a worksurface coupled to a base;

a seat for a user coupled to the base;

a partition configured for attachment to the worksurface;

wherein the worksurface is movable with respect to the base between an open and a closed position with respect to an entry portal to the workstation.

25. The workstation of claim 24 further comprising an enclosure at least partially surrounding the worksurface.

26. The workstation of claim 25 wherein the enclosure has a passageway providing access to the worksurface.

27. The workstation of claim 26 wherein the worksurface and the partition are selectively rotatable to limit access to the workstation.

28. The workstation of claim 27 wherein the worksurface and the partition are selectively rotatable to limit physical access to the workstation.

29. The workstation of claim 28 wherein the worksurface and the partition are selectively rotatable to limit visual access to the workstation.

30. The workstation of claim 29 wherein a utility carrier is interconnected between the base and a primary worksurface.

31. The workstation of claim 30 wherein the utility carrier is configured to accommodate rotation of the primary worksurface relative to the base.

32. The workstation of claim 31 wherein the base operably engages a commutator for transmitting utilities to the primary worksurface.

33. The workstation of claim 24 wherein a utility carrier is interconnectable from a source external to the base to at least one appliance on the primary worksurface.

34. The workstation of claim 24 wherein the utilities include at least one of power, voice and data.

35. The workstation of claim 24 wherein the primary workstation is rotatable for 360 degrees with respect to the base.

36. A workstation comprising:

a primary worksurface configured for rotation and coupled to a base configured for rotation;

a hub having an input utility carrier from a utility supply source; and an output utility carrier operatively coupled to the input utility carrier and communicating between the hub and the primary worksurface for transmitting utilities from the utility supply source to the primary worksurface.

37. The workstation of claim 36 wherein the utilities include at least one of power, voice and data.

38. The workstation of claim 37 wherein the hub is stationary.

39. The workstation of claim 38 wherein the second utility carrier has a length configured for rotation of the primary workstation for 360 degrees relative to the base.

40. The workstation of claim 39 further comprising a stop configured to restrict the rotation of the primary workstation.

41. The workstation of claim 40 wherein the hub has a stationary portion operatively coupled to a rotatable portion.

42. The workstation of claim 36 wherein the output utility carrier has a fixed length.

43. The workstation of claim 42 wherein the rotation of the primary worksurface is unrestricted.

* * * * *